US007158744B2

(12) United States Patent
Okamura

(10) Patent No.: US 7,158,744 B2
(45) Date of Patent: Jan. 2, 2007

(54) DEVELOPING DEVICE, IMAGE FORMING APPARATUS, AND IMAGE FORMING SYSTEM

(75) Inventor: Takehiko Okamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 10/944,443

(22) Filed: Sep. 17, 2004

(65) Prior Publication Data

US 2005/0078985 A1 Apr. 14, 2005

(30) Foreign Application Priority Data

Sep. 18, 2003 (JP) ..... 2003-326410
Sep. 18, 2003 (JP) ..... 2003-326411

(51) Int. Cl.
*G03G 15/08* (2006.01)

(52) U.S. Cl. ..... 399/284

(58) Field of Classification Search ..... 399/111, 399/119, 227, 283, 284, 286
See application file for complete search history.

(56) References Cited

U.S. PATENT DOCUMENTS 5,893,014 A * 4/1999 Goto et al. ..... 399/286
2003/0095804 A1* 5/2003 Tanaka et al. ..... 399/13

FOREIGN PATENT DOCUMENTS

| | | |
|---|---|---|
| JP | 2000-147828 | 5/2000 |
| JP | 2000-347499 | 12/2000 |
| JP | 2003-021925 | 1/2003 |
| JP | 2003-021930 | 1/2003 |
| JP | 2003-058009 | 2/2003 |
| JP | 2003-107905 | 4/2003 |
| JP | 2004-109461 | 4/2004 |

* cited by examiner

*Primary Examiner*—Hoang Ngo
(74) *Attorney, Agent, or Firm*—Hogan & Hartson LLP

(57) ABSTRACT

A developing device is provided with a developer bearing body for bearing developer that includes a release agent, and a charging member for charging the developer borne by the developer bearing body by abutting against the developer bearing body. The charging member is electrically conductive. The developer, which has been charged by the charging member, is used for developing a latent image borne by an image bearing body.

25 Claims, 8 Drawing Sheets

DEVELOPING DEVICE, IMAGE FORMING APPARATUS, AND IMAGE FORMING SYSTEM

CROSS-REFERENCE TO RELATED APPLICATIONS

The present application claims priority upon Japanese Patent Application No. 2003-326410 filed Sep. 18, 2003 and Japanese Patent Application No. 2003-326411 filed Sep. 18, 2003, which are herein incorporated by reference.

BACKGROUND OF THE INVENTION

1. Field of the Invention

The present invention relates to developing devices, image forming apparatuses, and image forming systems.

2. Description of the Related Art (1) There are known image forming apparatuses that are provided with, for example: an image bearing body for bearing a latent image; a developing device for developing the latent image borne by the image bearing body using developer; a transferring device for transferring, onto a medium, the developer image that has been made visible by the developing device developing the latent image with the developer; and a fusing device for fusing, to the medium, the developer image that has been transferred onto the medium using the transferring device. When an image forming apparatus of this type receives image signals etc. from an external device such as a host computer, it positions the developing device at a developing position which is in opposition to the image bearing body. The image forming apparatus then forms a developer image by developing the latent image borne by the image bearing body with the developer contained in the developing device, transfers the developer image onto a medium, and fuses the image to the medium to thereby form an image on the medium.

In order to achieve the above-mentioned function of developing the latent image formed on the image bearing body, the developing device of the type described above is provided with, for example, a developer bearing body for bearing the developer, and a charging member for charging the developer borne by the developer bearing body by abutting against it. Such a developing device charges the developer borne by the developer bearing body using the charging member, and develops the latent image borne by the image bearing body with the charged developer.

Further, the developer used in such an image forming apparatus contains a sufficient amount of release agent. Therefore, in consideration of maintainability etc., the fusing device of the image forming apparatus is not provided with oil for preventing the medium from adhering to the fusing device when the developer image is fused to the medium. (Refer, for example, to JP 2003-107905A.)

Incidentally, in such an image forming apparatus, a phenomenon called "white spots" may occur when the developer including the release agent is electrically charged by the charging member and the charged developer is used for developing the latent image borne by the image bearing body. Occurrence of such a phenomenon may cause deterioration in the images that are finally obtained.

(2) There are also known image forming apparatuses that are provided with, for example: an image bearing body for bearing a latent image; a developing device for developing the latent image borne by the image bearing body using developer; and a turnable turning body to which the developing device is attached. When an image forming apparatus of this type receives image signals etc. from an external device such as a host computer, it positions the developing device at a developing position, which is in opposition to the image bearing body, by turning the turning body about its axis of turning. The image forming apparatus then forms a developer image by developing the latent image borne by the image bearing body with the developer contained in the developing device, and transfers the developer image onto a medium to thereby form an image on the medium.

In order to achieve the above-mentioned function of developing the latent image formed on the image bearing body, the developing device of the type described above is provided with, for example, a developer container for containing the developer, a developer bearing body for bearing the developer contained in the developer container, and a charging member for charging the developer borne by the developer bearing body by abutting against it. Such a developing device charges the developer borne by the developer bearing body using the charging member, and develops the latent image borne by the image bearing body with the charged developer.

Further, in such an image forming apparatus, the developer in the developing device, which is attached to the turning body, is stirred as the turning body is turned, and accordingly, the developer is maintained in a suitable state. Therefore, the developer container is not provided with a stirring member for stirring the developer. (Refer, for example, to JP 2000-347499A.)

However, in situations where an image is continuously formed on a plurality of sheets of media with developer of a single color (for example, monochrome) using the image forming apparatus described above, the same developing device will be used for the development for a long time, and thus, the turning body will not be turned for a long time.

If, in a state where the turning body is not turned for a long time, development is carried out continuously with the developer borne by the developer bearing body without the developer being stirred, then the amount of charge of the developer in the vicinity of the developer bearing body, among all of the developer contained in the developer container, becomes excessively large. That is, developer with a significantly different amount of charge will co-exist in the developer container (and polarization in the characteristics of the developer will occur). This will bring about electrostatic agglomeration of the developer when the developer is mixed. The developer that has caused electrostatic agglomeration may spill when, for example, the developer that has been mixed is used for developing the latent image.

SUMMARY OF THE INVENTION

The present invention has been made in view of the above and other issues, and an object thereof is to provide a developing device, an image forming apparatus, and an image forming system which are capable of appropriately preventing deterioration in image quality. Another object of the present invention is to provide an image forming apparatus and an image forming system which are capable of appropriately preventing developer from spilling.

An aspect of the present invention is a developing device comprising:

a developer bearing body for bearing developer that includes a release agent; and a charging member for charging the developer borne by the developer bearing body by abutting against the developer bearing body, the charging member being electrically conductive, and the developer, which has been charged by the charging member, being used for developing a latent image borne by an image bearing body.

Another aspect of the present invention is an image forming apparatus comprising:

an image bearing body for bearing a latent image;

a developing device that is provided with:

a developer container for containing developer, the developer container not being provided with a stirring member for stirring the developer;

a developer bearing body for bearing the developer contained in the developer container; and a charging member for charging the developer borne by the developer bearing body by abutting against the developer bearing body, the charging member being electrically conductive, and the developer, which has been charged by the charging member, being used for developing the latent image borne by the image bearing body; and a turnable turning body to which the developing device is attached.

Features and objects of the present invention other than the above will become clear through the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
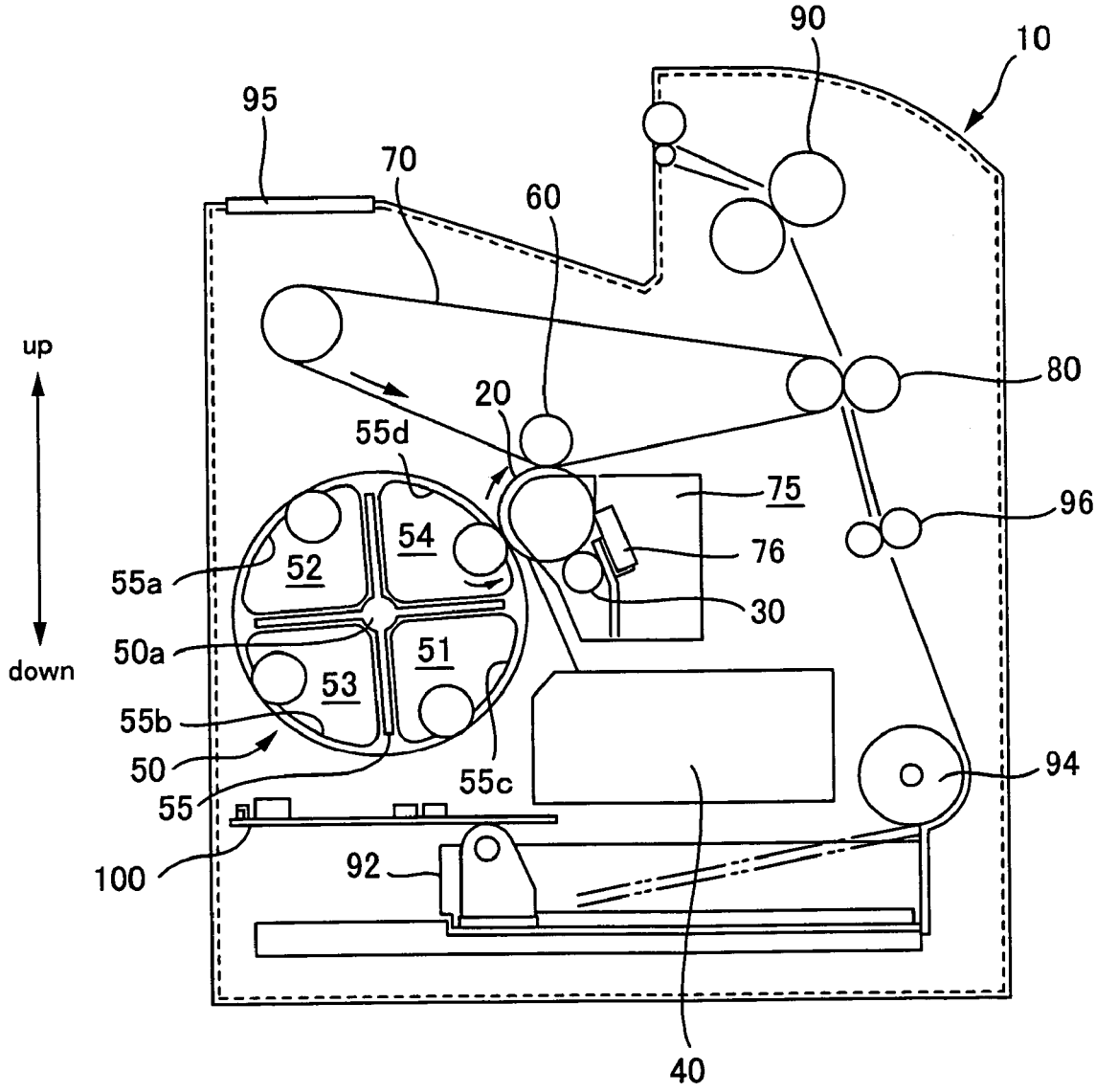
FIG. 1 is a diagram showing main structural components constructing an image forming apparatus according to an embodiment of the present invention.

At least the following matters will be made clear by the explanation in the present specification and the description of the accompanying drawings.

(1) An aspect of the present invention is a developing device comprising:

a developer bearing body for bearing developer that includes a release agent; and a charging member for charging the developer borne by the developer bearing body by abutting against the developer bearing body, the charging member being electrically conductive, and the developer, which has been charged by the charging member, being used for developing a latent image borne by an image bearing body.

By making the charging member electrically conductive, it is possible to appropriately prevent deterioration in image quality.

Further, the developer may have a core particle that includes the release agent; and the amount of the release agent added may be 2 to 7 wt % with respect to the core particle.

In this case, it is possible to appropriately prevent the medium from adhering to the fusing device when the developer image is fused to the medium, even without providing the fusing device with oil.

Further, the release agent may be non-miscible to the core particle.

In such a state, the function of the electrically-conductive charging member, which prevents occurrence of "white spots" by reducing the charge amount of the excessively-charged developer and appropriately prevents deterioration in image quality, becomes even more important and the object of the present invention is achieved more advantageously.

Further, the developer may be manufactured according to a milling method.

In such a state, the function of the electrically-conductive charging member, which prevents occurrence of "white spots" by reducing the charge amount of the excessively-charged developer and appropriately prevents deterioration in image quality, becomes even more important and the object of the present invention is achieved more advantageously.

Further, the developing device may further comprise a rotatable developer stripping member for stripping off the developer borne by the developer bearing body; the developer bearing body may be rotatable; and the rotating direction of the developer stripping member may be opposite from the rotating direction of the developer bearing body.

In such a state, the function of the electrically-conductive charging member, which prevents occurrence of "white spots" by reducing the charge amount of the excessively-charged developer and appropriately prevents deterioration in image quality, becomes even more important and the object of the present invention is achieved more advantageously.

Further, the developer stripping member may supply the developer to the developer bearing body.

In this case, it is possible to provide a single member with two functions, thereby making effective use of that member.

Further, the latent image borne by the image bearing body may be developed with the developer according to jumping development.

In this case, it is possible to appropriately prevent the developer from spilling.

Further, the developing device may further comprise a metal supporting member for supporting the charging member.

By making the supporting member out of metal, it is possible to reduce the charge amount of the excessively-charged developer more effectively.

Further, the charging member may include carbon black.

Use of carbon black as the electrically-conductive agent is superior in cost performance, and also allows to appropriately maintain the electric conductivity even when there are environmental changes.

It is also possible to achieve a developing device comprising: a developer bearing body for bearing developer that includes a release agent; and a charging member for charging the developer borne by the developer bearing body by abutting against the developer bearing body; wherein the charging member is electrically conductive; wherein the developer, which has been charged by the charging member, is used for developing a latent image borne by an image bearing body; wherein the developer has a core particle that includes the release agent; wherein the amount of the release agent added is 2 to 7 wt % with respect to the core particle; wherein the release agent is not miscible to the core particle; wherein the developer is manufactured according to a milling method; wherein the developing device further comprises a rotatable developer stripping member for stripping off the developer borne by the developer bearing body; wherein the developer bearing body is rotatable; wherein the rotating direction of the developer stripping member is opposite from the rotating direction of the developer bearing body; wherein the developer stripping member supplies the developer to the developer bearing body; wherein the latent image borne by the image bearing body is developed with the developer according to jumping development; wherein the developing device further comprises a metal supporting member for supporting the charging member; and wherein the charging member includes carbon black.

It is also possible to achieve an image forming apparatus comprising: an image bearing body for bearing a latent image; a developing device that is provided with a developer bearing body for bearing developer that includes a release agent, and a charging member for charging the developer borne by the developer bearing body by abutting against the developer bearing body, the charging member being electrically conductive, and the developer, which has been charged by the charging member, being used for developing the latent image borne by the image bearing body; a transferring device for transferring, onto a medium, a developer image that has been made visible by the developing device developing the latent image with the developer; and a fusing device for fusing, to the medium, the developer image that has been transferred onto the medium by the transferring device, the fusing device not being provided with oil for preventing the medium from adhering to the fusing device when the developer image is fused to the medium.

It is also possible to achieve an image forming system comprising: a computer; and an image forming apparatus that is connectable to the computer and that includes: an image bearing body for bearing a latent image; a developing device that is provided with a developer bearing body for bearing developer that includes a release agent, and a charging member for charging the developer borne by the developer bearing body by abutting against the developer bearing body, the charging member being electrically conductive, and the developer, which has been charged by the charging member, being used for developing the latent image borne by the image bearing body; a transferring device for transferring, onto a medium, a developer image that has been made visible by the developing device developing the latent image with the developer; and a fusing device for fusing, to the medium, the developer image that has been transferred onto the medium by the transferring device, the fusing device not being provided with oil for preventing the medium from adhering to the fusing device when the developer image is fused to the medium.

Image forming systems achieved as above are superior to conventional systems as a whole.

(2) Another aspect of the present invention is an image forming apparatus comprising: an image bearing body for bearing a latent image; a developing device that is provided with a developer container for containing developer, the developer container not being provided with a stirring member for stirring the developer, a developer bearing body for bearing the developer contained in the developer container, and a charging member for charging the developer borne by the developer bearing body by abutting against the developer bearing body, the charging member being electrically conductive, and the developer, which has been charged by the charging member, being used for developing the latent image borne by the image bearing body; and a turnable turning body to which the developing device is attached.

By making the charging member electrically conductive, it is possible to appropriately prevent the developer from spilling.

Further, the turning body may be a rotatable rotating body.

In this case, it is possible to stir the developer contained in the developing device, which is attached to the turning body, more appropriately.

Further, the developer container may be provided with a partitioning wall that protrudes inward from an inner wall of the developer container and that is for partitioning the developer, and two developer containing sections partitioned by the partitioning wall; one of the two developer containing sections may be provided with an opening; and the developer bearing body may be provided facing the opening.

In such a state, the function of the electrically-conductive charging member, which prevents occurrence of polarization by reducing the charge amount of the excessively-charged developer, becomes even more important and the object of the present invention is achieved more advantageously.

Further the developer contained in the two developer containing sections of the developing device that has been attached to the turning body may be mixed when the turning body is turned.

By making the charging member electrically conductive, it is possible to appropriately prevent the developer from spilling due to the developer, which is contained in the two developer containing sections of the developing device that has been attached to the turning body, being mixed when the turning body is turned.

Further, a rotatable developer stripping member for stripping off the developer borne by the developer bearing body may be provided in the one developer containing section, of the two developer containing sections, that is provided with the opening; the developer bearing body may be rotatable; and the rotating direction of the developer stripping member may be opposite from the rotating direction of the developer bearing body.

In such a state, the increase in the charge amount of the developer in the vicinity of the developer bearing body becomes significant. Therefore, the function of the electrically-conductive charging member, which reduces the charge amount of the excessively-charged developer, becomes even more important and the object of the present invention is achieved more advantageously.

Further, the developer stripping member may supply the developer to the developer bearing body.

In this case, it is possible to provide a single member with two functions, thereby making effective use of that member.

Further, an abutting position at which the charging member abuts against the developer bearing body may be below the position of the center of rotation of the developer bearing body.

In such a state, the function of the electrically-conductive charging member of appropriately preventing spilling of the developer, which has caused electrostatic agglomeration and whose electric charge has weakened, by reducing the charge amount of the excessively-charged developer becomes even more important and the object of the present invention is achieved more advantageously.

Further, the developing device may be provided with a metal supporting member for supporting the charging member.

By making the supporting member out of metal, it is possible to reduce the charge amount of the excessively-charged developer more effectively.

Further, the charging member may include carbon black.

Use of carbon black as the electrically-conductive agent is superior in cost performance, and also allows to appropriately maintain the electric conductivity even when there are environmental changes.

Further, a plurality of the developing devices may be attached to the turning body; and the developer container of each of the developing devices may contain developer of a different color.

In such a state, a situation in which the turning body is not turned for a long time when an image is continuously formed with a single-color developer on a plurality of sheets of media is likely to occur. Therefore, the present invention becomes more important, and the object of the present invention is achieved more advantageously.

Further, among the plurality of developing devices, there may be a developing device that is provided with a developer container containing black developer.

It is most likely that the single-color developer is black when an image is continuously formed with a single-color developer on a plurality of sheets of media. Therefore, the present invention becomes more important, and the object of the present invention is achieved more advantageously.

It is also possible to achieve an image forming apparatus comprising: an image bearing body for bearing a latent image; a developing device that is provided with a developer container for containing developer, the developer container not being provided with a stirring member for stirring the developer, a developer bearing body for bearing the developer contained in the developer container, and a charging member for charging the developer borne by the developer bearing body by abutting against the developer bearing body, the charging member being electrically conductive, and the developer, which has been charged by the charging member, being used for developing the latent image borne by the image bearing body; and a turnable turning body to which the developing device is attached; wherein the turning body is a rotatable rotating body; wherein the developer container is provided with a partitioning wall that protrudes inward from an inner wall of the developer container and that is for partitioning the developer, and two developer containing sections partitioned by the partitioning wall; wherein one of the two developer containing sections is provided with an opening; wherein the developer bearing body is provided facing the opening; wherein, when the turning body is turned, the developer contained in the two developer containing sections of the developing device that has been attached to the turning body is mixed; wherein a rotatable developer stripping member for stripping off the developer borne by the developer bearing body is provided in the one developer containing section, of the two developer containing sections, that is provided with the opening; wherein the developer bearing body is rotatable; wherein the rotating direction of the developer stripping member is opposite from the rotating direction of the developer bearing body; wherein the developer stripping member supplies the developer to the developer bearing body; wherein an abutting position at which the charging member abuts against the developer bearing body is below the position of the center of rotation of the developer bearing body; wherein the developing device is provided with a metal supporting member for supporting the charging member; wherein the charging member includes carbon black; wherein a plurality of the developing devices are attached to the turning body; wherein the developer container of each of the developing devices contains developer of a different color; and wherein, among the plurality of developing devices, there is a developing device that is provided with a developer container containing black developer.

It is also possible to achieve an image forming system comprising: a computer; and an image forming apparatus that is connectable to the computer and that includes: an image bearing body for bearing a latent image; a developing device that is provided with a developer container for containing developer, the developer container not being provided with a stirring member for stirring the developer, a developer bearing body for bearing the developer contained in the developer container, and a charging member for charging the developer borne by the developer bearing body by abutting against the developer bearing body, the charging member being electrically conductive, and the developer, which has been charged by the charging member, being used for developing the latent image borne by the image bearing body; and a turnable turning body to which the developing device is attached.

Image forming systems achieved as above are superior to conventional systems as a whole.

It should be noted that the term "turn (turning; turnable)" is used herein to refer to "a circular movement of more than 0 degrees in both the clockwise and counterclockwise directions", and the term "rotate (rotating; rotatable)" is used herein to refer to "a circular movement of more than 0 degrees in either the clockwise or counterclockwise direction".

Overall Configuration Example of Image Forming Apparatus

Next, with reference to FIG. 1, an outline of an image-forming apparatus will be described, taking a laser-beam printer 10 (hereinafter referred to also as "printer") as an example. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment is provided with a charging unit 30, an exposing unit 40, a YMCK developing unit 50 which serves as an example of a rotatable rotating body, a first transferring unit 60, an intermediate transferring body 70, and a cleaning unit 75. These components are arranged in the direction of rotation of a photoconductor 20, which serves as an example of an image bearing body for bearing a latent image. The printer 10 is further provided with a second transferring unit 80, a fusing unit 90, a displaying unit 95 constructed of a liquid-crystal panel and serving as means for making notifications to a user, and a control unit 100 for controlling these units etc. and managing the operations as a printer.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image information having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54. The toner T is an example of developer contained in each of the developing devices.

The YMCK developing unit 50 can move the positions of the four developing devices 51, 52, 53, and 54 by rotating while the developing devices 51, 52, 53, and 54 are in an attached state. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated about a rotating shaft 50*a* while maintaining their relative positions. Every time an image forming process for one page is finished, each of the developing devices selectively opposes the photoconductor 20 to successively develop the latent image formed on the photoconductor 20 using the toner T contained in each of the developing devices 51, 52, 53, and 54. It should be noted that each of the four developing devices 51, 52, 53, and 54 described above is attachable to and detachable from the respective holding sections of the YMCK developing unit 50. Further, details on the YMCK developing unit 50 and the developing devices will be described further below.

The transferring device is a device for transferring a toner image that has been made visible by the developing device developing the latent image with the toner T. In the present embodiment, the transferring device is composed of the first transferring unit 60 and the second transferring unit 80.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, and cloth.

The fusing unit 90 is a device for fusing the single-color toner image or the full-color toner image, which has been transferred onto the medium, to the medium to make it into a permanent image. It should be noted that there are cases in which a fusing roller (not shown) provided in the fusing unit 90 is coated with oil to prevent the medium from adhering to the fusing roller when the toner image is fused to the medium, but in the present embodiment, oil is not provided in the fusing unit 90 in consideration of maintainability etc.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
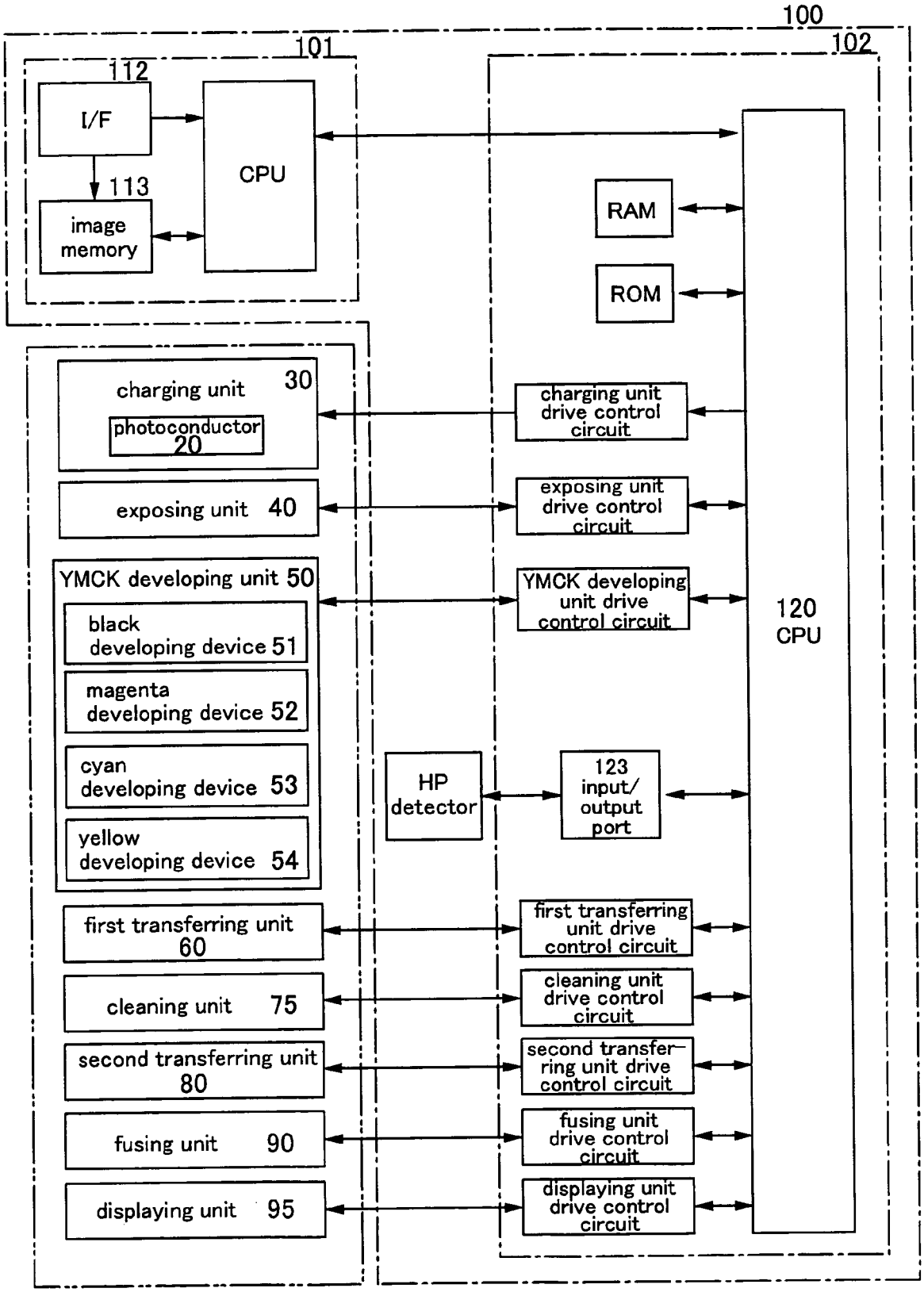
FIG. 2 is a block diagram showing a control unit of the image forming apparatus shown in FIG. 1.

The control unit 100 is provided with a main controller 101 and a unit controller 102 as shown in FIG. 2. Image signals and control signals are input to the main controller 101, and according to instructions based on the image signals and control signals, the unit controller 102 controls each of the above-mentioned units etc. to form an image.

Next, operations of the printer 10 structured as above will be described with reference to other structural components.

First, when image signals and control signals are input from the not-shown host computer to the main controller 101 of the printer 10 through an interface (I/F) 112, the photoconductor 20, a developing roller as an example of a developer bearing body, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54, which contains yellow (Y) toner, in the developing position, which is in opposition to the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner T has been charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors using each of the developing devices, toner images in four colors corresponding to the respective image signals are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for electrical charging for forming the next latent image. The scraped-off toner T is collected in a remaining-toner collector of the cleaning unit 75.

Configuration Example of Developing Device

Figure 3:
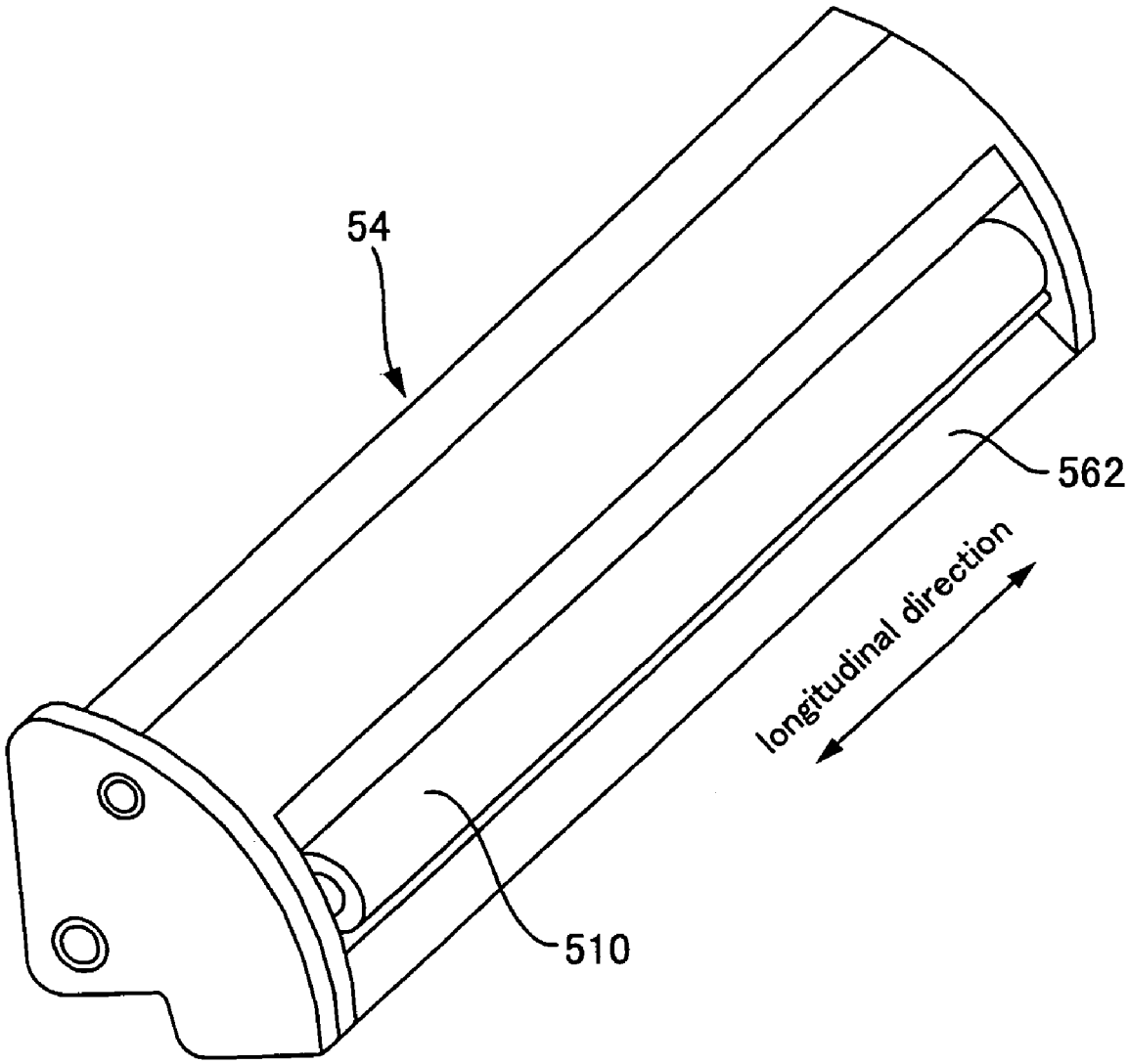
FIG. 3 is a conceptual diagram of a developing device.
Figure 4:
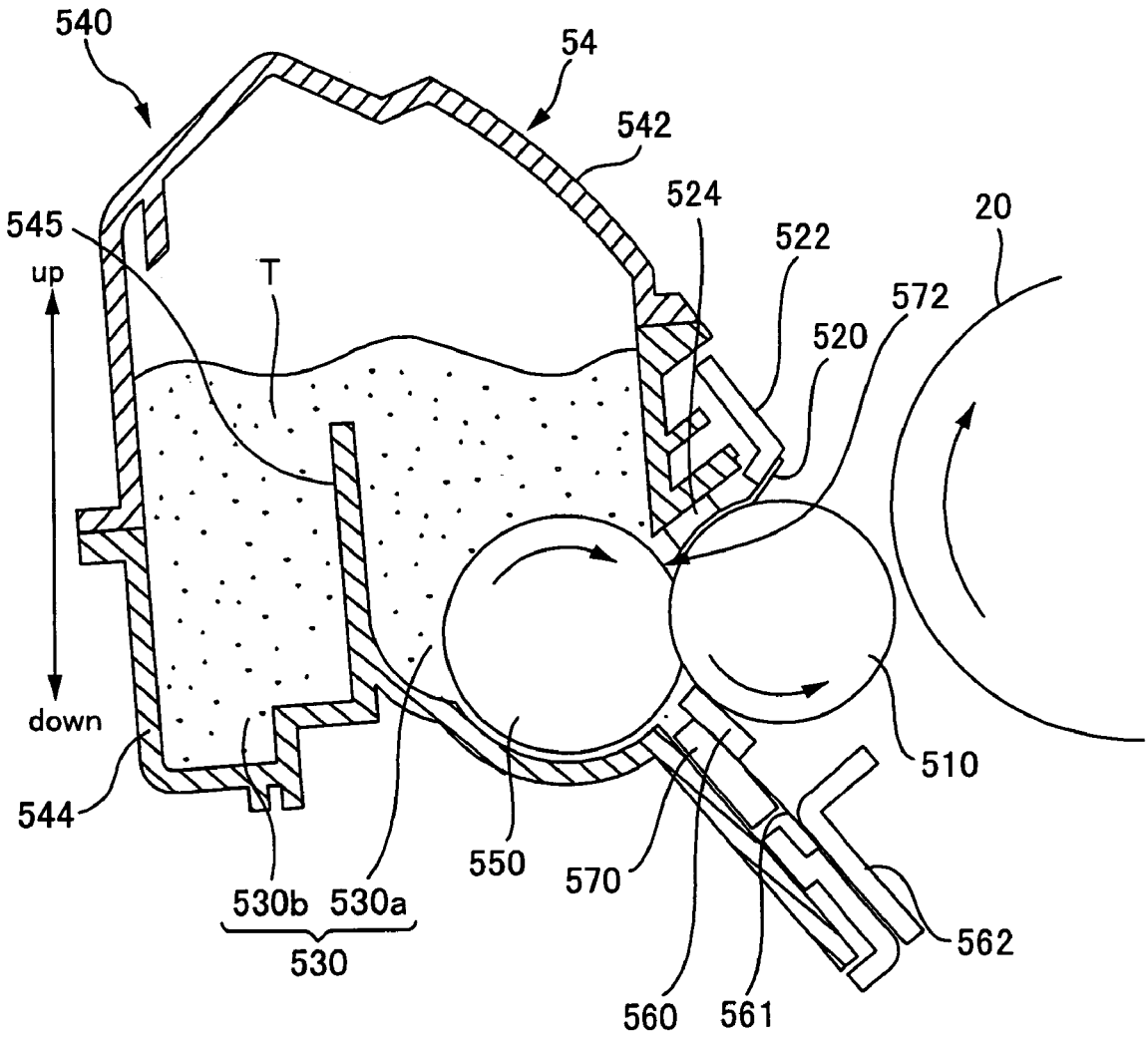
FIG. 4 is a section view showing main structural components of the developing device.
Figure 5:
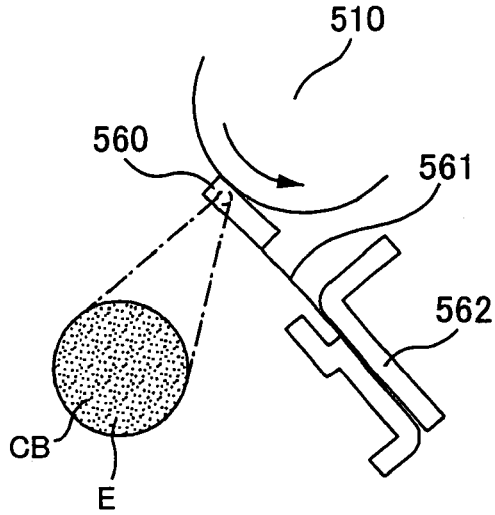
FIG. 5 is a conceptual diagram showing a restriction blade 560 in which carbon black CB is dispersed in a macromolecular elastic body E.

Next, with reference to FIG. 3 through FIG. 5, an example of a configuration of the developing device will be described. FIG. 3 is a conceptual diagram of a developing device. FIG. 4 is a section view showing main structural components of the developing device. FIG. 5 is a conceptual diagram showing a restriction blade 560 in which carbon black CB is dispersed in a macromolecular elastic body E. It should be noted that the section view shown in FIG. 4 is a section of the developing device bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing device 54 is shown to be in a state in which it is positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, description will be made only about the yellow developing device 54 below.

The yellow developing device 54 has, for example, the developing roller 510, a sealing member 520, a toner container 530 serving as an example of a developer container, a housing 540, a toner supplying roller 550 serving as an example of a developer stripping member, and a restriction blade 560 serving as an example of a charging member.

The developing roller 510 bears toner T and delivers it to the developing position opposing the photoconductor 20. The developing roller 510 is made of metal and manufactured from, for example, aluminum alloy such as aluminum alloy 5056 or aluminum alloy 6063, or iron alloy such as STKM, and where necessary, the roller 510 is plated with, for example, nickel plating or chromium plating. Further, as shown in FIG. 3, the developing roller 510 is supported at both ends in its longitudinal direction and is rotatable about its central axis. As shown in FIG. 4, the developing roller 510 rotates in the opposite direction (counterclockwise in FIG. 4) from the rotating direction of the photoconductor 20 (clockwise in FIG. 4). The central axis of the roller 510 is located below the central axis of the photoconductor 20. Further, as shown in FIG. 4, a gap exists between the developing roller 510 and the photoconductor 20 when the yellow developing device 54 comes into opposition to the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20. That is, in the present embodiment, the latent image borne by the photoconductor 20 is developed with the toner T according to jumping development.

The sealing member 520 prevents the toner T in the yellow developing device 54 from spilling out therefrom, and also collects the toner T, which is on the developing roller 510 that has passed the developing position, into the developing device without scraping it off. The sealing member 520 is a seal made of, for example, polyethylene film. The sealing member 520 is supported by a seal-supporting metal plate 522, and is attached to the housing 540 via the seal-supporting metal plate 522. A seal-urging member 524 made of, for example, Moltoprene is provided on one side of the sealing member 520 opposite from the side of the developing roller 510. The sealing member 520 is pressed against the developing roller 510 by the elastic force of the seal-urging member 524. It should be noted that the abutting position at which the sealing member 520 abuts against the developing roller 510 is located above the central axis of the developing roller 510.

The housing 540 is manufactured by welding together a plurality of integrally-molded housing sections, that is, an upper housing section 542 and a lower housing section 544. A toner container 530 for containing the toner T is formed inside the housing 540. The toner container 530 is divided into two toner containing sections, that is, the first toner containing section 530*a* and the second toner containing section 530*b* by a partitioning wall 545 that is for partitioning the toner T and that protrudes inward (in the up/down direction of FIG. 4) from the inner wall of the toner container 530. The upper sections of the first toner containing section 530*a* and the second toner containing section 530*b* are in communication, and the movement of the toner T between them is restricted by the partitioning wall 545 when in the state shown in FIG. 4. However, when the YMCK developing unit 50 is rotated, the toner contained in the first toner containing section 530*a* and the second toner containing section 530*b* is once gathered in the side of the communicated section, which is on the upper side when the developing device is at the developing position, and when the device returns to the state shown in FIG. 4, the toner is mixed and then returned to the first toner containing section 530*a* and the second toner containing section 530*b*. That is, the toner T in the developing devices is appropriately stirred by the rotation of the YMCK developing unit 50.

For this reason, no stirring member is provided in the toner container 530 of this embodiment. However, a stirring member for stirring the toner T contained in the toner container 530 may be provided.

Further, as shown in FIG. 4, the housing 540 (that is, the first toner containing section 530*a*) has an opening 572 at its lower section. The developing roller 510 is provided facing this opening 572.

The toner supplying roller 550 is provided in the first toner containing section 530*a* described above, and supplies the toner T contained in the first toner containing section 530*a* to the developing roller 510 and also strips off the toner T remaining on the developing roller 510 therefrom after development. The toner supplying roller 550 is made of, for example, polyurethane foam, and is made to abut against the developing roller 510 in an elastically deformed state. The toner supplying roller 550 is arranged at a lower section of the first toner containing section 530*a*. The toner T contained in the first toner containing section 530*a* is supplied to the developing roller 510 by the toner supplying roller 550 at the lower section of the first toner containing section 530*a*. The toner supplying roller 550 is rotatable about its central axis. The central axis of the toner supplying roller 550 is located below the central axis of rotation of the developing roller 510. Further, the toner supplying roller 550 rotates in the opposite direction (clockwise in FIG. 4) from the rotating direction of the developing roller 510 (counterclockwise in FIG. 4).

The restriction blade 560 gives an electric charge to the toner T borne by the developing roller 510 as well as restricts the thickness of the layer of the toner T borne by the developing roller 510. As shown in FIG. 5, the restriction blade 560 is a component made by dispersing an electrically-conductive agent in a macromolecular elastic body E such as silicone rubber or urethane rubber, and thus is electrically conductive.

In the present embodiment, carbon black CB is used as the electrically-conductive agent. This, however, is not a limitation, and any kind of material having electric conductivity such as metal or metal oxide may be employed. Carbon black CB, however, is more preferable in terms that it is superior in cost performance and that it can appropriately maintain electric conductivity even when there are environmental changes. Further, in addition to the electrically-conductive agent, it is possible to disperse an electrically-conductive adjuvant, such as ionic-conductive agents, in the macromolecular elastic body E. Further, in the present embodiment, the electric potential of the restriction blade 560 and the developing roller 510 is set to be the same. This, however, is not a limitation, and there may be a potential difference between the restriction blade 560 and the developing roller 510.

The restriction blade 560 is supported by a blade-supporting thin plate 561 which serves as an example of a metal supporting member. The blade-supporting thin plate 561 is a thin plate that is made of, for example, phosphor bronze or stainless steel, and that has a spring-like characteristic. The blade-supporting thin plate 561 is mounted to the housing 540 via a pair of supporting metal plates 562 in a state that one end of the blade-supporting thin plate 561 is pinched between and supported by the supporting metal plates 562. Further, a blade-backing member 570 made of, for example, Moltoprene is provided on one side of the restriction blade 560 opposite from the side of the developing roller 510.

The restricting blade 560 is pressed against the developing roller 510 by the elastic force caused by the flexure of the blade-supporting thin plate 561. Further, the blade-backing member 570 prevents the toner T from entering in between the blade-supporting thin plate 561 and the housing 540, stabilizes the elastic force caused by the flexure of the blade-supporting thin plate 561, and also, applies force to the restricting blade 560 from the back thereof towards the developing roller 510 to press the restricting blade 560 against the developing roller 510. In this way, the blade-backing member 570 makes the restricting blade 560 abut against the developing roller 510 more evenly.

The end of the restricting blade 560 opposite from the end that is being supported by the supporting metal plates 562, i.e., the tip end of the restriction blade 560, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces towards the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

In the yellow developing device 54 structured as above, the toner supplying roller 550 supplies the toner T contained in the toner containing sections 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the charged toner Ton the developing roller 510 reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing device by the sealing member 520 without being scraped off. Then, the toner T that still remains on the developing roller 510 can be stripped off by the toner supplying roller 550.

Overview of YMCK Developing Unit

Next, an overview of the YMCK developing unit 50 will be described with reference to FIG. 6A and FIG. 6B.

The YMCK developing unit 50 has a rotating shaft 50*a* positioned at the center. A support frame 55 for holding the developing devices is fixed to the rotating shaft 50*a*. The rotating shaft 50*a* is provided extending between two frame side plates (not shown) which form a casing of the printer 10, and both ends of the shaft 50*a* are supported.

The support frame 55 is provided with the four holding sections 55*a*, 55*b*, 55*c*, and 55*d*, by which the above-described developing devices 51, 52, 53, and 54 of the four colors are held in an attachable/detachable manner about the rotating shaft 50*a*, in the circumferential direction at an interval of 90°.

A pulse motor, which is not shown, is connected to the rotating shaft 50*a* via a clutch. By driving the pulse motor, it is possible to rotate the support frame 55 and position the four developing devices 51, 52, 53, and 54 at predetermined positions.

Figure 6A:
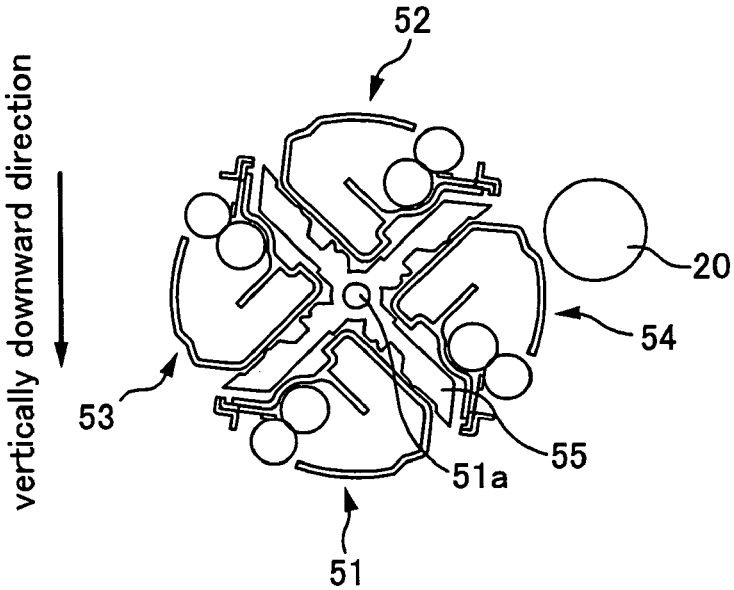
FIG. 6A shows the home position, which serves as a reference position in the rotating direction of a YMCK developing unit 50.
Figure 6B:
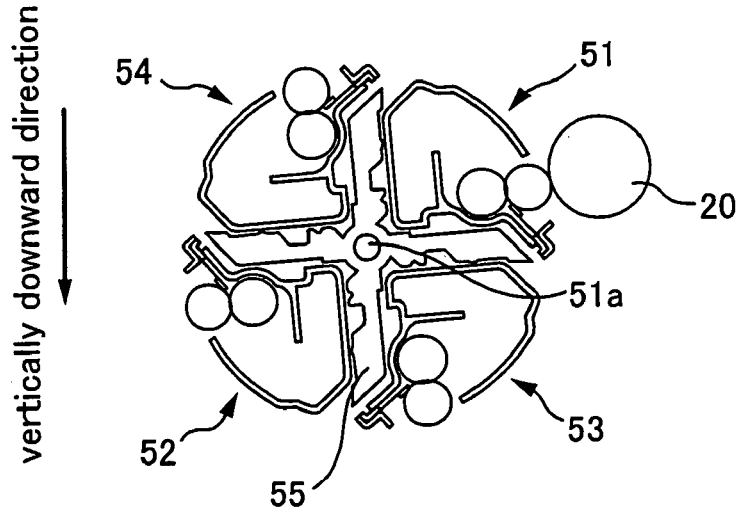
FIG. 6B shows the developing position where a black developing device 51, which is attached to the YMCK developing unit 50, is in opposition to a photoconductor 20.

FIG. 6A and FIG. 6B are diagrams showing two halt positions of the rotating YMCK developing unit 50. FIG. 6A shows the home position (referred to as "HP position" below) which is the reference position in the rotating direction of the YMCK developing unit 50. FIG. 6B shows the developing position where the black developing device 51, which is attached to the YMCK developing unit 50, is in opposition to the photoconductor 20.

In FIG. 6B, the developing position is explained with regard to the black developing device 51, but this position becomes the developing position for each of the other developing devices when the YMCK developing unit 50 is rotated at 90° intervals.

An HP detector (not shown) for detecting the HP position is provided on the side of one end of the rotating shaft 50*a* of the YMCK developing unit 50. The HP detector is structured of a disk that is for generating signals and that is fixed to one end of the rotating shaft 50*a*, and an HP sensor that is made up of, for example, a photointerrupter having a light emitting section and a light receiving section. The circumferential section of the disk is arranged so that it is positioned between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing unit 50 is detected based on this change in signal level and the number of pulses of the pulse motor, and by taking this HP position as a reference, each of the developing devices can be positioned at the developing position etc.

FIG. 6B shows the developing position of the black developing device 51 which is achieved by rotating the pulse motor for a predetermined number of pulses from the above-mentioned HP position. At this developing position, the developing roller 510 of the black developing device 51 and the photoconductor 20 oppose each other, and development using black toner becomes possible. Further, when the pulse motor rotates the YMCK developing unit 50 by 90° in the counterclockwise direction, the developing position for the cyan developing device 53 is achieved, and every time the YMCK developing unit 50 is rotated by 90°, the developing position for each developing device is successively achieved.

One of the two frame side plates that support the YMCK developing unit 50 and that structure the casing of the printer 10 is provided with a not-shown attach/detach dedicated opening through which one developing device can pass. The attach/detach dedicated opening is formed at a position where only a relevant developing device can be pulled out in the direction of the rotating shaft 50*a* when the YMCK developing unit 50 is rotated and the relevant developing device is halted at its developing device attach/detach position, which is set respectively for each developing device. Further, the attach/detach dedicated opening is formed slightly larger than the outer shape of a developing device, and at the developing device attach/detach position, it is possible to insert a new developing device through this attach/detach dedicated opening in the direction of the rotating shaft 50*a* and attach the developing device to the support frame 55. While the developing devices are positioned at positions other than the developing device attach/detach position, the attached state of the developing devices is retained by the frame side plates.

It should be noted that a lock mechanism, which is not shown, is provided for certainly positioning and fixing the YMCK developing unit 50 at the developing position and the attach/detach dedicated position.

Overview of Control Unit

Next, with reference to FIG. 2, the configuration of the control unit 100 will be described. The main controller 101 of the control unit 100 is connected to the host computer through the interface 112, and has an image memory 113 for storing image signals that have been input from the host computer. The unit controller 102 is electrically connected to each of the units of the main apparatus (i.e., the charging unit 30, the exposing unit 40, the YMCK developing unit 50, the first transferring unit 60, the cleaning unit 75, the second transferring unit 80, the fusing unit 90, and the displaying unit 95). By receiving signals from sensors provided on each of the units, the unit controller 102 detects the state of each of the units and controls the units according to the signals input from the main controller 101. Further, the HP detector described above is connected to a CPU 120 via an input/output port 123.

Toner Structure

Next, the structure of the toner T according to the present embodiment will be described. The toner T includes a core particle and external additives. The core particle and external additives are made to adhere to each other through dry mixing using, for example, mixers adopting mechanochemical methods or high-speed fluid mixers such as a Henschel mixer and a Papenmeier mixer. The toner T of the present embodiment has negative polarity, but toner having positive polarity may as well be used.

The core particle includes materials such as coloring agents, charge control agents, release agents (WAX), and resin. The core particle is manufactured according to a known milling method, such as the kneading-and-milling method, using the above-described materials. It should be noted that the core particle can further include, for example, dispersing agents, magnetic materials, and other additives.

For example, it is possible to use one kind, or two or more kinds blended together, of the following materials as the core particle: polystyrene and copolymers thereof, such as hydrogenated styrene resins, styrene/isobutylene copolymers, ABS resins, ASA resins, AS resins, AAS resins, ACS resins, AES resins, styrene/p-chlorostyrene copolymers, styrene/propylene copolymers, styrene/butadiene crosslinked polymers, styrene/butadiene/chlorinated-paraffin copolymers, styrene/allylalcohol copolymers, styrene/butadiene rubber emulsions, styrene/maleate copolymers, styrene/isobutylene copolymers, and styrene/maleic anhydride copolymers; acrylate resins, methacrylate resins, and copolymers thereof; styrene/acrylic resins and copolymers thereof, such as styrene/acrylic copolymers, styrene/diethylaminoethyl methacrylate copolymers, styrene/butadiene/acrylate copolymers, styrene/methyl methacrylate copolymers, styrene/n-butyl methacrylate copolymers, styrene/methyl methacrylate/n-butyl acrylate copolymers, styrene/methyl methacrylate/butyl acrylate/N-(ethoxymethyl) acrylamide copolymers, styrene/glycidyl methacrylate copolymers, styrene/butadiene/dimethyl aminoethyl methacrylate copolymers, styrene/acrylate/maleate copolymers, styrene/methyl methacrylate/2-ethylhexyl acrylate copolymers, styrene/n-butyl acrylate/ethylglycol methacrylate copolymers, styrene/n-butyl methacrylate/acrylic acid copolymers, styrene/n-butyl methacrylate/maleic anhydride copolymers, and styrene/butyl acrylate/isobutyl maleic acid half-ester/divinylbenzene copolymers; polyester and copolymers thereof; polyethylene and copolymers thereof; epoxy resins; silicone resins; polypropylene and copolymers thereof; fluorocarbon resins; polyamide resins; polyvinyl alcohol resins; polyurethane resins; and polyvinyl butyral resins.

For example, it is possible to use the following materials as coloring agents: carbon black; spirit black; nigrosine; rhodamines; triaminotriphenylmethane; cations; dioxazine; copper phthalocyanine pigments; perylene; azo dyes; metal-containing azo pigments; azo chromium complexes; carmines; benzidines; solar pure yellow 8G; quinacridon; polytungstophosphoric acid; Indanthrene blue; and sulfonamide derivatives.

For example, it is possible to use the following materials as charge control agents: electron acceptor organic complexes; chlorinated polyethers; nitrohumic acid; quaternary ammonium salts; and pyridinyl salts.

The following materials are preferably used as the release agents (WAX): low molecular-weight polypropylene; low molecular-weight polyethylene; ethylene bis-amide; and paraffin-based waxes such as microcrystalline wax, carnauba wax, and bees wax. This, however, is not a limitation, and any kind of material may be used as long as it is not miscible to the core particle of the toner and stays separate therefrom. Note that, in the present embodiment, "not miscible" indicates a state in which, when melted and mixed, the wax disperses in the core particle like islands without being taken into the molecular chain of the resin.

It should be noted that, as described above, the fusing unit 90 of the present embodiment is not provided with the oil for preventing the medium from adhering to the fusing unit 90 when the toner image is fused to the medium. Instead, in the present embodiment, a sufficient amount of release agent is included in the core particle so that it is not necessary to provide the oil. The amount of release agent added is 2 to 7 wt % with respect to the amount of the core particle.

For example, it is possible to use metallic soaps and polyethylene glycol as dispersing agents. As other additives, it is possible to use, for example, zinc stearate, zinc oxide, and ceric oxide.

For example, it is possible to use the following materials as the magnetic materials: metal powder such as Fe, Co, Ni, Cr, Mn, and Zn; metal oxides such as $Fe_3O_4$, $Fe_2O_3$, $Cr_2O_3$, and ferrites; and alloys that display ferromagnetism by treating, for example, alloys containing manganese and acid with heat. The magnetic material may be pretreated in advance with, for example, a coupling agent.

It is possible to use, as the external additives, various materials whose surface has been treated to have hydrophobic characteristics. Silica is used as the external additive for the toner T according to the present embodiment. Other than silica, it is possible to use inorganic particles such as: particles of metal oxides, such as titanium oxide, aluminum oxide, strontium titanate, ceric oxide, magnesium oxide, and chromium oxide; particles of nitrides, such as silicon nitride; particles of carbides, such as silicon carbide; particles of metal salts, such as calcium sulfate, barium sulfate, and calcium carbonate; and materials obtained by combining the above. It is also possible to use organic particles such as particles of acrylic resin. Further, it is possible to use, for example, silane coupling agents, titanate coupling agents, fluorine-containing silane coupling agents, and silicone oil as surface treatment agents for treating the external additives. It is preferable that the hydrophobic ratio of the external additives having been treated with the above-mentioned treatment agents is 60% or higher, according to a conventional methanol method. If the ratio is lower than this value, deterioration in the electrical-charging characteristic and fluidity will easily occur in a hot and wet environment due to adsorption of moisture, and therefore it is not preferable. It is preferable for the particle size of the external additives to be 0.001 to 1 μm from the viewpoint of carrying performance and electrical-charging characteristics. Further, the number of kinds of the external additives is not limited to one, but a blend containing two or more kinds of external additives can be used.

Mechanism According to Which White Spots Occur

Figure 7:
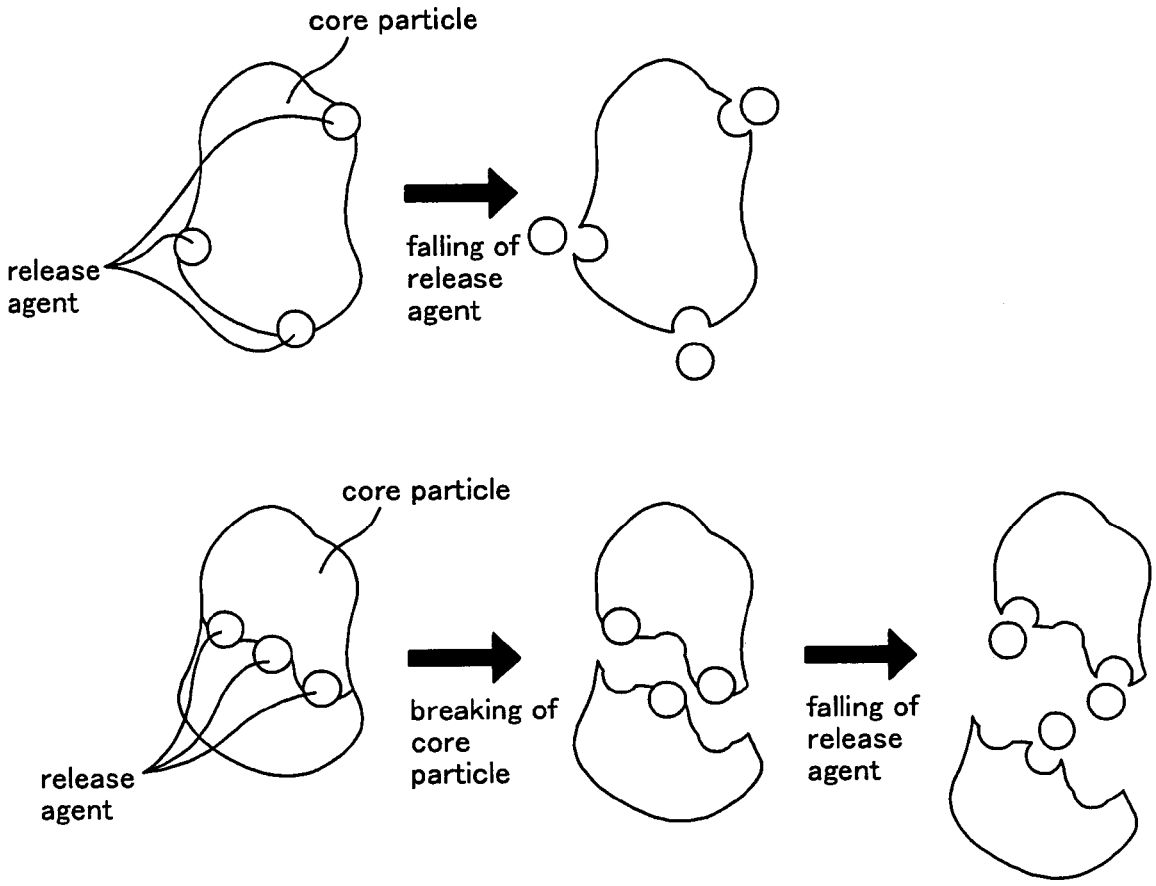
FIG. 7 is a conceptual diagram for illustrating the characteristics of toner T including a release agent.

As described in the section of the "Description of the Related Art", a phenomenon called "white spots" may occur when the toner T including a release agent is electrically charged by the restriction blade 560 and the charged toner T is used for developing the latent image borne by the photoconductor 20. Below, the mechanism according to which "white spots" occur is described with reference to FIG. 7. FIG. 7 is a conceptual diagram for illustrating the characteristics of the toner T including a release agent.

<Characteristics of Toner T Including a Release Agent>

First, the characteristics of the toner T including a release agent is described with reference to FIG. 7. The toner T including a release agent has a characteristic in that it is prone to break and thus form so-called "fine toner", which is toner that is smaller than toner having a size suitable for developing latent images.

For example, as shown in the figures in the upper section of FIG. 7, when release agents are located on the surface of the core particle of the toner T that has been manufactured according to the milling method, the release agents are prone to fall off from the core particle. When the release agents fall off from the core particle, these release agents that have fallen off turn into fine toner.

Further, as shown in the figures in the lower section of FIG. 7, even when the release agents are not located on the surface of the core particle, the core particle becomes prone to break if the release agents are located close to each other within the core particle. When the core particle breaks, the core particle that has broken up turns into fine toner. Further, in this case, the release agents will be located on the surface of the broken core particle, and thus, the release agents become prone to fall off from the core particle. When the release agents fall off from the core particle, these release agents that have fallen off also turn into fine toner.

As described above, the amount of fine toner contained in the toner T including a release agent is significantly larger than the amount of fine toner contained in a toner T that does not include a release agent. The fine toner is more prone to being electrically charged because its surface area per volume is large, and thus, the amount of charge of the fine toner will become excessively large when it is electrically charged by the restriction blade 560.

<Mechanism According to Which White Spots Occur>

When the restriction blade 560 applies an electric charge to the toner T borne by the developing roller 510, a counter-charge of a polarity (positive polarity in the present embodiment) opposite from the polarity of the electric charge applied to the toner T (negative polarity in the present embodiment) is generated on the surface of the restriction blade 560. If the toner T includes a release agent, then generation of excessively-charged toner (i.e., toner whose amount of charge has become excessively large) becomes more significant, and thus the amount of charge of the counter-charge also becomes excessively large. As the amount of charge becomes large, the electric charge that has built up on the surface of the restriction blade 560 sooner or later discharges electricity onto the surface of the developing roller 510. This gives rise to unevenness in the toner carried on the developing roller 510, the unevenness appearing on the surface of the developing roller 510 as small circular spots (which are called "white spots"). The white spots that have appeared on the surface of the developing roller 510 cause deterioration, such as unevenness in darkness, in the images that are finally obtained.

Effect of Preventing Deterioration in Image Quality Obtained by the Electrically-conductive Restriction Blade As described above, the restriction blade 560 of the present embodiment is electrically conductive. By using this electrically-conductive restriction blade 560, it becomes possible to appropriately prevent deterioration in image quality.

More specifically, as described in the section of the "Mechanism according to which white spots occur", if the toner T includes a release agent, then generation of excessively-charged toner becomes more significant, and thus the amount of charge of the counter-charge also becomes excessively large. As the amount of charge becomes large, the electric charge that has built up on the surface of the restriction blade 560 sooner or later discharges electricity onto the surface of the developing roller 510, thereby giving rise to "white spots". The white spots that have appeared on the surface of the developing roller 510 cause deterioration, such as unevenness in darkness, in the images that are finally obtained.

In view of the above, an electrically-conductive restriction blade 560 is used for electrically charging the toner T borne by the developing roller 510. While the electrically-conductive restriction blade 560 applies an electric charge to the toner T borne by the developing roller 510, it also takes away the electric charge of the toner T whose amount of charge has become excessively large, thereby functioning as to reduce the amount of charge of the toner T. This function allows to reduce the generation of excessively-charged toner, thus reducing the increase in the amount of charge of the counter-charge. Therefore, it becomes possible to prevent the "white spots" from appearing, and thus, prevent deterioration in image quality such as unevenness in darkness.

Effect of Preventing Toner From Spilling Obtained by the Electrically-conductive Restriction Blade As described above, the restriction blade 560 of the present embodiment is electrically conductive. By using this electrically-conductive restriction blade 560, it becomes possible to appropriately prevent the toner T from spilling.

More specifically, as described in the section of the "Description of the Related Art", when an image is to be continuously formed on a plurality of sheets of media with toner T of a single color (for example, monochrome) using the printer 10 described above, the same developing device will be used for the development for a long time, and therefore, the YMCK developing unit 50 will not be turned for a long time.

If, in a state where the YMCK developing unit 50 is not turned for a long time, the toner T is electrically charged by the restriction blade 560 without being stirred and development is carried out continuously with the toner T borne by the developing roller 510, then the amount of charge of the toner T in the vicinity of the developing roller 510, among all of the toner T contained in the toner container 530, becomes excessively large. That is, toner T with a significantly different amount of charge will co-exist in the toner container 530 (i.e., polarization in the characteristics of the toner T will occur between a position close to the developing roller 510 and a position far from it). This will bring about electrostatic agglomeration of the toner T when the toner T is mixed by, for example, the YMCK developing unit 50 turning after completion of the continuous development. This gives rise to spilling of the toner T, whose electric charge has weakened due to the electrostatic agglomeration (i.e., the toner T whose electric charge has weakened falls off from the developing roller 510 after passing the abutting position where the restriction blade 560 abuts against the developing roller 510), when, for example, the toner T that has been mixed is used for developing a latent image.

In view of the above, an electrically-conductive restriction blade 560 is used for electrically charging the toner T borne by the developing roller 510, as described in the above embodiment. While the electrically-conductive restriction blade 560 applies an electric charge to the toner T borne by the developing roller 510, it also takes away the electric charge of the toner T whose amount of charge has become excessively large, thereby functioning as to reduce the amount of charge of the toner T.

Therefore, it becomes possible to reduce the increase in the amount of charge of the toner T in the vicinity of the developing roller 510, and thus, prevent the above-mentioned polarization from occurring. In this way, it becomes possible to appropriately prevent the occurrence of spilling of the toner T, whose electric charge has weakened due to the electrostatic agglomeration, when the toner T is mixed by, for example, the YMCK developing unit 50 turning after completion of the continuous development and the toner T that has been mixed is used for developing a latent image.

It should be noted that another countermeasure for preventing the above-mentioned problem is to stir the toner T by turning the YMCK developing unit at a predetermined frequency when continuously forming an image on a plurality of sheets of media using single-color toner. This countermeasure, however, has a drawback in that the time required for image formation becomes long because development cannot be performed while the YMCK developing unit is being turned.

On the other hand, by using an electrically-conductive restriction blade 560, it is not necessary to adopt the above-mentioned countermeasure. Further, even when the above-mentioned countermeasure is adopted, it becomes possible to lessen the predetermined frequency and therefore eliminate the drawback that the time required for image formation becomes long.

Other Embodiments

In the foregoing, a developing device, an image forming apparatus etc. of the present invention were described according to an embodiment thereof. However, the foregoing embodiment of the invention is for the purpose of elucidating the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to full-color laser beam printers that are not of the intermediate transferring type. Further, not only is the present invention applicable to full-color laser beam printers, but it is also applicable to monochrome laser beam printers. Furthermore, other than printers, the present invention is applicable to various other types of image forming apparatuses, such as copying machines and facsimiles.

Further, the photoconductor is not limited to a so-called photoconductive roller having a structure in which a photoconductive layer is provided on the outer peripheral surface of a cylindrical, electrically-conductive base. The photoconductor can be a so-called photoconductive belt structured by providing a photoconductive layer on a surface of a belt-like electrically-conductive base, for example.

Further, in the foregoing embodiment, the toner supplying roller 550, which served as the developer stripping member, supplied the toner T to the developing roller 510. That is, the toner supplying roller 550 was provided with two functions, i.e., the function of stripping off the toner T, and the function of supplying the toner T. This, however, is not a limitation.

The foregoing embodiment, however, is more preferable because it is possible to provide a single member with two functions, thereby making effective use of that member.

Further, in the foregoing embodiment, the developing device further included a metal blade-supporting thin plate 561 for supporting the restriction blade 560. This, however, is not a limitation. For example, the developing device may have a blade-supporting thin plate 561 made of a material other than metal.

The foregoing embodiment, however, is more preferable because by making the blade-supporting thin plate 561 out of metal, it is possible to reduce the charge amount of the excessively-charged toner T more effectively.

Further, in the foregoing embodiment, the toner T had a core particle that includes the release agent; and the amount of the release agent added was 2 to 7 wt % with respect to the core particle. This, however, is not a limitation. For example, the amount of release agent added may be less than 2 wt % or more than 7 wt % with respect to the core particle.

The foregoing embodiment, however, is more preferable because when the amount of the release agent added is 2 to 7 wt % with respect to the core particle, it is possible to appropriately prevent the medium from adhering to the fusing unit 90 when the toner image is fused to the medium, even without providing the fusing unit 90 with oil.

Further, in the foregoing embodiment, the release agent was non-miscible to the core particle. This, however, is not a limitation, and the release agent does not have to be non-miscible.

When the release agent is non-miscible to the core particle, the functions of the release agent are achieved more appropriately, but on the other hand, the core particle is prone to break and the release agent is prone to fall off, as described in the section of "Characteristics of toner T including a release agent". Therefore, generation of excessively-charged toner becomes more significant, and thus, white spots are more likely to appear.

In such a state, the function of the electrically-conductive restriction blade 560, which prevents occurrence of "white spots" by reducing the charge amount of the excessively-charged toner and appropriately prevents deterioration in image quality, becomes even more important and the object of the present invention is achieved more advantageously.

Further, in the foregoing embodiment, the toner T was manufactured according to a milling method. This, however, is not a limitation. For example, the toner T may be manufactured according to the polymerization method.

When, however, the toner T is manufactured according to the milling method, the toner T becomes prone to breaking. Therefore, generation of excessively-charged toner becomes more significant, and thus, white spots are more likely to appear.

In such a state, the function of the electrically-conductive restriction blade 560, which prevents occurrence of "white spots" by reducing the charge amount of the excessively-charged toner and appropriately prevents deterioration in image quality, becomes even more important and the object of the present invention is achieved more advantageously.

Further, in the foregoing embodiment, the developing device further included a rotatable toner supplying roller 550 for stripping off the toner T borne by the developing roller 510; the developing roller 510 was rotatable; and the rotating direction of the toner supplying roller 550 was opposite from the rotating direction of the developing roller 510. This, however, is not a limitation. For example, the rotating direction of the toner supplying roller 550 may be the same as the rotating direction of the developing roller 510.

When, however, the rotating direction of the toner supplying roller 550 is opposite from the rotating direction of the developing roller 510, the toner-stripping ability of the toner supplying roller 550 is lower compared to when the rotating directions are the same, and thus, the frequency that the restriction blade 560 repetitively charges the same toner T becomes higher. Therefore, generation of excessively-charged toner becomes more significant, and thus, white spots are more likely to appear.

In such a state, the function of the electrically-conductive restriction blade 560, which prevents occurrence of "white spots" by reducing the charge amount of the excessively-charged toner and appropriately prevents deterioration in image quality, becomes even more important and the object of the present invention is achieved more advantageously.

Further, in the foregoing embodiment, the latent image borne by the photoconductor 20 was developed with the toner T according to jumping development. This, however, is not a limitation, and other development methods may be adopted for developing the latent image.

In development using the jumping development method, a plurality of toner layers are formed on the developing roller 510. If the toner T includes a release agent, then the amount of fine toner becomes large, and because the fine toner forms the inner layer, the electrical charging of the toner in the outer layer is inhibited. As a result, the electric charge of the toner in the outer layer becomes weak, and the possibility that the toner in the outer layer spills becomes high.

The foregoing embodiment is therefore more effective because the above-mentioned problem can be prevented by reducing the amount of charge of the fine toner using the electrically-conductive restriction blade 560 in case the latent image borne by the photoconductor 20 is to be developed according to jumping development.

Further, in the foregoing embodiment, the YMCK developing unit 50 was a rotatable rotating body. This, however, is not a limitation. For example, the YMCK developing unit 50 may be turnable, but not rotatable.

The foregoing embodiment, however, is more preferable because it is possible to stir the toner T contained in the developing device, which is attached to the YMCK developing unit 50, more appropriately.

Further, in the foregoing embodiment, the toner container 530 was provided with a partitioning wall 545 that protrudes inward from an inner wall of the toner container 530 and that is for partitioning the toner T, and two toner containing sections 530*a* and 530*b* partitioned by the partitioning wall 545; one (the first toner containing section 530*a*) of the two toner containing sections 530*a* and 530*b* was provided with an opening 572; and the developing roller 510 was provided facing the opening 572. This, however, is not a limitation. For example, there may only be one toner containing section, without providing the partitioning wall 545.

However, in cases where the toner container 530 is provided with two toner containing sections 530*a* and 530*b* partitioned by the partitioning wall 545, where one (the first toner containing section 530*a*) of the two toner containing sections 530*a* and 530*b* is provided with an opening 572, and where the developing roller 510 is provided facing the opening 572, the above-described polarization in the characteristics of the toner becomes significant because the toner T in the first toner containing section 530*a* and the toner T in the second toner containing section 530*b* are partitioned off from each other.

In such a state, the function of the electrically-conductive restriction blade 560, which prevents occurrence of the polarization by reducing the charge amount of the excessively-charged toner T, becomes even more important. The foregoing embodiment is therefore more effective because the object of the present invention is achieved more advantageously.

Further, in the foregoing embodiment, a rotatable toner supplying roller 550 for stripping off the toner T borne by the developing roller 510 was provided in the toner containing section 530*a*, of the two toner containing sections 530*a* and 530*b*, that is provided with the opening 572; the developing roller 510 was rotatable; and the rotating direction of the toner supplying roller 550 was opposite from the rotating direction of the developing roller 510. This, however, is not a limitation. For example, the rotating direction of the toner supplying roller 550 may be the same as the rotating direction of the developing roller 510.

When, however, the rotating direction of the toner supplying roller 550 is opposite from the rotating direction of the developing roller 510, the toner-stripping ability of the toner supplying roller 550 is lower compared to when the rotating directions are the same, and thus, the frequency that the restriction blade 560 repetitively charges the same toner T becomes higher. Thus, in such a state, the increase in the charge amount of the toner T in the vicinity of the developing roller 510 becomes significant. Therefore, the function of the electrically-conductive restriction blade 560, which reduces the charge amount of the excessively-charged toner T, becomes even more important. The foregoing embodiment is therefore more effective because the object of the present invention is achieved more advantageously.

Further, in the foregoing embodiment, an abutting position at which the restriction blade 560 abuts against the developing roller 510 was below the position of the center of rotation of the developing roller 510. This, however, is not a limitation. For example, the abutting position may be above the position of the center of rotation of the developing roller 510.

When the abutting position is located below the position of the center of rotation of the developing roller 510, excessively-charged toner T tends to be generated in the lower section of the toner containing section 530*a*. Further, in such a situation, the possibility that the excessively-charged toner T remains in the lower section of the toner containing section 530*a* is high, even when the toner T is mixed by, for example, turning of the YMCK developing unit 50. In this case, the gravity acting on the toner T in the upper section of the toner containing section 530*a* is applied on the excessively-charged toner T which is in the lower section of the toner containing section 530*a*, and therefore, occurrence of the above-described electrostatic agglomeration becomes significant.

Therefore, in such a state, the function of the electrically-conductive restriction blade 560 of appropriately preventing spilling of the toner T, which has caused electrostatic agglomeration and whose electric charge has weakened, by reducing the charge amount of the excessively-charged toner T becomes even more important. The foregoing embodiment is therefore more effective because the object of the present invention is achieved more advantageously.

Further, in the foregoing embodiment, a plurality of the developing devices (i.e., four developing devices) were attached to the YMCK developing unit 50; and the toner container 530 of each of the developing devices contained toner T of a different color (i.e., yellow toner, magenta toner, cyan toner, or black toner). This, however, is not a limitation. For example, toner T of the same color may be contained in the toner container 530 of all of the developing devices.

When, however, a plurality of the developing devices are attached to the YMCK developing unit 50 and the toner container 530 of each developing device contains toner T of a different color, a situation in which the YMCK developing unit 50 is not turned for a long time when an image is continuously formed with a single-color toner T on a plurality of sheets of media is more likely to occur, compared to when toner T of the same color is contained. The foregoing embodiment is therefore more preferable because, in such a situation, the present invention becomes more important, and the object of the present invention is achieved more advantageously.

Further, in the foregoing embodiment, there was a developing device 51, among the plurality of developing devices, provided with a toner container 530 containing black toner T. This, however, is not a limitation. For example, a developing device 51 provided with a toner container 530 containing black toner T does not have to be included among the plurality of developing devices.

However, it is most likely that the single-color toner is black when an image is continuously formed with a single-color toner on a plurality of sheets of media. The foregoing embodiment is therefore more preferable because in such a case, the present invention becomes more important, and the object of the present invention is achieved more advantageously.

Configuration of Image Forming System etc.

Next, an embodiment of an image forming system, which serve as an example of an embodiment of the present invention, is described with reference to the drawings.

Figure 8:
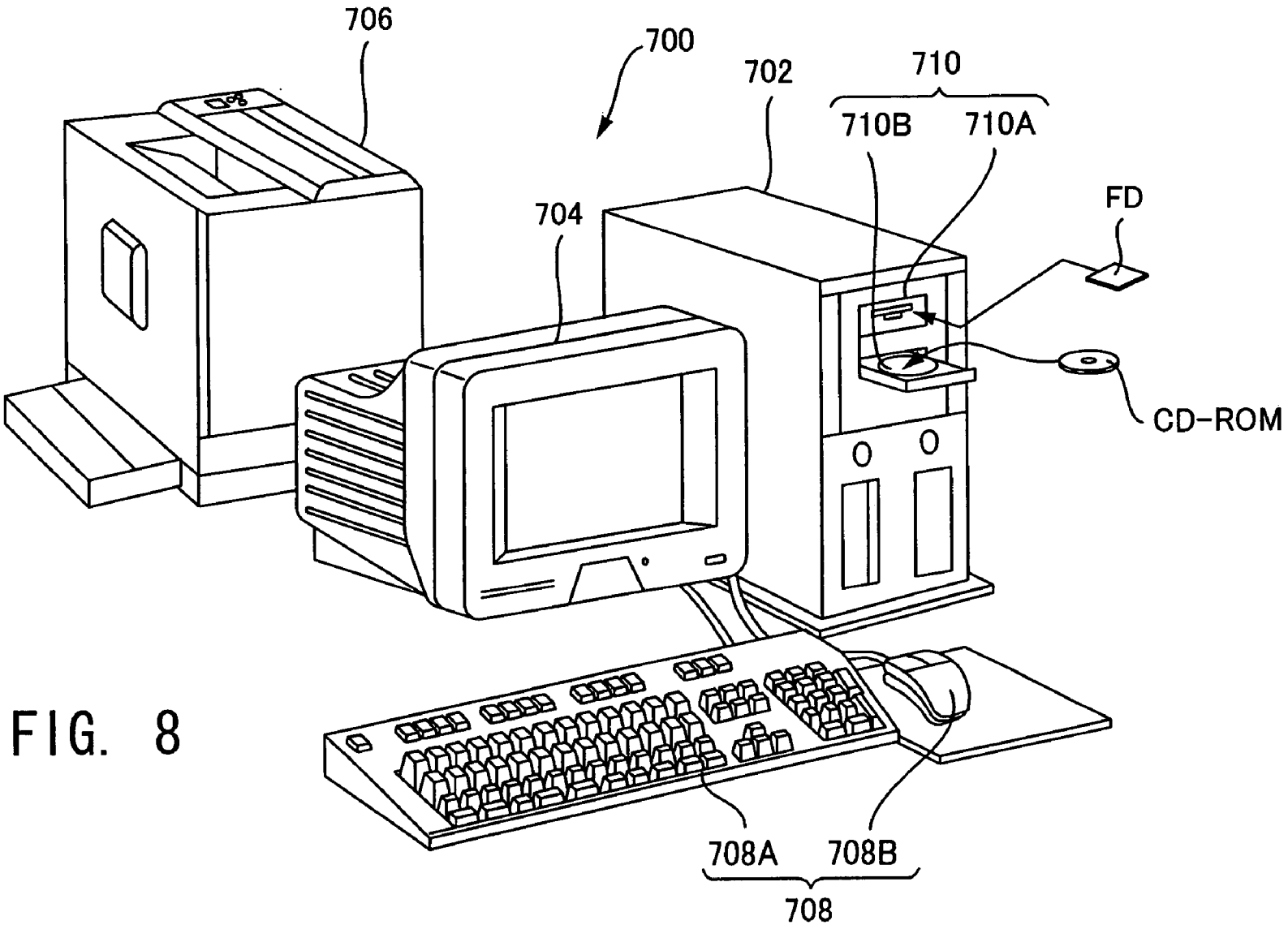
FIG. 8 is an explanatory diagram showing an external configuration of an image forming system.

FIG. 8 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 9:
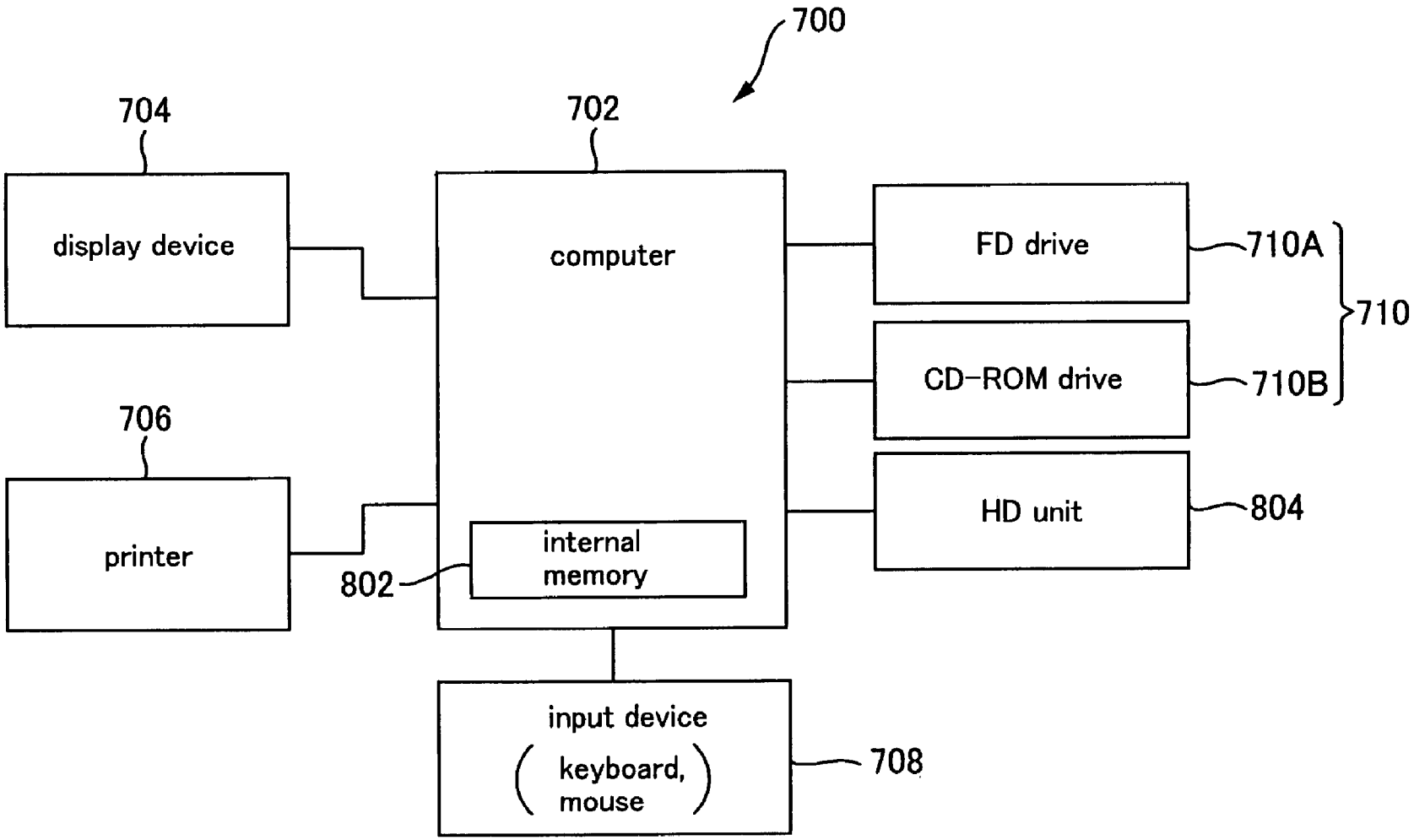
FIG. 9 is a block diagram showing a configuration of the image forming system shown in FIG. 8.

FIG. 9 is a block diagram showing a configuration of the image forming system shown in FIG. 8. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device comprising:

a developer bearing body for bearing developer that includes a release agent; and a charging member for charging said developer borne by said developer bearing body by abutting against said developer bearing body, said charging member being electrically conductive, and said developer, which has been charged by said charging member, being used for developing a latent image borne by an image bearing body, wherein the charging member has a macromolecular elastic body and an electrical-conductive agent dispersed in the macromolecular elastic body.

2. A developing device according to claim 1, wherein:

said developer has a core particle that includes said release agent; and the amount of said release agent added is 2 to 7 wt % with respect to said core particle.

3. A developing device according to claim 2, wherein said release agent is not miscible to said core particle.

4. A developing device according to claim 1, wherein said developer is manufactured according to a milling method.

5. A developing device according to claim 1, wherein:

said developing device further comprises a rotatable developer stripping member for stripping off said developer borne by said developer bearing body;

said developer bearing body is rotatable; and the rotating direction of said developer stripping member is opposite from the rotating direction of said developer bearing body.

6. A developing device according to claim 5, wherein said developer stripping member supplies the developer to said developer bearing body.

7. A developing device according to claim 5, wherein the latent image borne by said image bearing body is developed with said developer according to jumping development.

8. A developing device according to claim 1, wherein said developing device further comprises a metal supporting member for supporting said charging member.

9. A developing device according to claim 1, wherein said charging member includes carbon black as the electrically-conductive agent.

10. A developing device comprising:

a developer bearing body for bearing developer that includes a release agent; and a charging member for charging said developer borne by said developer bearing body by abutting against said developer bearing body;

wherein said charging member is electrically conductive;

wherein said developer, which has been charged by said charging member, is used for developing a latent image borne by an image bearing body;

wherein said developer has a core particle that includes said release agent;

wherein the amount of said release agent added is 2 to 7 wt % with respect to said core particle;

wherein said release agent is not miscible to said core particle;

wherein said developer is manufactured according to a milling method;

wherein said developing device further comprises a rotatable developer stripping member for stripping off said developer borne by said developer bearing body;

wherein said developer bearing body is rotatable;

wherein the rotating direction of said developer stripping member is opposite from the rotating direction of said developer bearing body;

wherein said developer stripping member supplies the developer to said developer bearing body;

wherein the latent image borne by said image bearing body is developed with said developer according to jumping development;

wherein said developing device further comprises a metal supporting member for supporting said charging member; and wherein said charging member has a macromolecular elastic body and an electrical-conductive agent dispersed in the macromolecular elastic body; and wherein said charging member includes carbon black as the electrically-conductive agent.

11. An image forming apparatus comprising:

an image bearing body for bearing a latent image;

a developing device that is provided with:

a developer bearing body for bearing developer that includes a release agent; and a charging member for charging said developer borne by said developer bearing body by abutting against said developer bearing body, said charging member being electrically conductive, and said developer, which has been charged by said charging member, being used for developing the latent image borne by said image bearing body;

a transferring device for transferring, onto a medium, a developer image that has been made visible by said developing device developing said latent image with said developer; and a fusing device for fusing, to said medium, said developer image that has been transferred onto said medium by said transferring device, said fusing device not being provided with oil for preventing said medium from adhering to said fusing device when said developer image is fused to said medium, wherein the charging member has a macromolecular elastic body and an electrical-conductive agent dispersed in the macromolecular elastic body.

12. An image forming system comprising:

a computer; and an image forming apparatus that is connectable to said computer and that includes:

an image bearing body for bearing a latent image;

a developing device that is provided with:

a developer bearing body for bearing developer that includes a release agent; and a charging member for charging said developer borne by said developer bearing body by abutting against said developer bearing body, said charging member being electrically conductive, and said developer, which has been charged by said charging member, being used for developing the latent image borne by said image bearing body;

a transferring device for transferring, onto a medium, a developer image that has been made visible by said developing device developing said latent image with said developer; and a fusing device for fusing, to said medium, said developer image that has been transferred onto said medium by said transferring device, said fusing device not being provided with oil for preventing said medium from adhering to said fusing device when said developer image is fused to said medium, wherein the charging member has a macromolecular elastic body and an electrical-conductive agent dispersed in the macromolecular elastic body.

13. An image forming apparatus comprising:

an image bearing body for bearing a latent image;

a developing device that is provided with:

a developer container for containing developer, said developer container not being provided with a stirring member for stirring said developer;

a developer bearing body for bearing the developer contained in said developer container; and a charging member for charging the developer borne by said developer bearing body by abutting against said developer bearing body, said charging member being electrically conductive, and said developer, which has been charged by said charging member, being used for developing the latent image borne by said image bearing body; and a turnable turning body to which said developing device is attached, wherein the charging member has a macromolecular elastic body and an electrical-conductive agent dispersed in the macromolecular elastic body.

14. An image forming apparatus according to claim 13, wherein said turning body is a rotatable rotating body.

15. An image forming apparatus according to claim 13, wherein:

said developer container is provided with a partitioning wall that protrudes inward from an inner wall of said developer container and that is for partitioning said developer, and two developer containing sections partitioned by said partitioning wall;

one of said two developer containing sections is provided with an opening; and said developer bearing body is provided facing said opening.

16. An image forming apparatus according to claim 15, wherein when said turning body is turned, the developer contained in said two developer containing sections of said developing device that has been attached to said turning body is mixed.

17. An image forming apparatus according to claim 15, wherein:

a rotatable developer stripping member for stripping off the developer borne by said developer bearing body is provided in the one developer containing section, of said two developer containing sections, that is provided with said opening;

said developer bearing body is rotatable; and the rotating direction of said developer stripping member is opposite from the rotating direction of said developer bearing body.

18. An image forming apparatus according to claim 17, wherein said developer stripping member supplies the developer to said developer bearing body.

19. An image forming apparatus according to claim 17, wherein an abutting position at which said charging member abuts against said developer bearing body is below the position of the center of rotation of said developer bearing body.

20. An image forming apparatus according to claim 13, wherein said developing device is provided with a metal supporting member for supporting said charging member.

21. An image forming apparatus according to claim 13, wherein said charging member includes carbon black as the electrically-conductive agent.

22. An image forming apparatus according to claim 13, wherein:

a plurality of the developing devices are attached to said turning body; and said developer container of each of said developing devices contains developer of a different color.

23. An image forming apparatus according to claim 22, wherein among said plurality of developing devices, there is a developing device that is provided with a developer container containing black developer.

24. An image forming apparatus comprising:

an image bearing body for bearing a latent image;

a developing device that is provided with:

a developer container for containing developer, said developer container not being provided with a stirring member for stirring said developer;

a developer bearing body for bearing the developer contained in said developer container; and a charging member for charging the developer borne by said developer bearing body by abutting against said developer bearing body, said charging member being electrically conductive, and said developer, which has been charged by said charging member, being used for developing the latent image borne by said image bearing body; and a tunable turning body to which said developing device is attached;

wherein said turning body is a rotatable rotating body;

wherein said developer container is provided with a partitioning wall that protrudes inward from an inner wall of said developer container and that is for partitioning said developer, and two developer containing sections partitioned by said partitioning wall;

wherein one of said two developer containing sections is provided with an opening;

wherein said developer bearing body is provided facing said opening;

wherein, when said tuning body is turned, the developer contained in said two developer containing sections of said developing device that has been attached to said tuning body is mixed;

wherein a rotatable developer stripping member for stripping off the developer borne by said developer bearing body is provided in the one developer containing section, of said two developer containing sections, that is provided with said opening;

wherein said developer bearing body is rotatable;

wherein the rotating direction of said developer stripping member is opposite from the rotating direction of said developer bearing body;

wherein said developer stripping member supplies the developer to said developer bearing body;

wherein an abutting position at which said charging member abuts against said developer bearing body is below the position of the center of rotation of said developer bearing body;

wherein said developing device is provided with a metal supporting member for supporting said charging member;

wherein said charging member includes carbon black;

wherein a plurality of the developing devices are attached to said turning body;

wherein said developer container of each of said developing devices contains developer of a different color; and wherein, among said plurality of developing devices, there is a developing device that is provided with a developer container containing black developer;

wherein the charging member has a macromolecular elastic body and an electrical-conductive agent dispersed in the macromolecular elastic body; and wherein said charging member includes carbon black as the electrically-conductive agent.

25. An image forming system comprising:

a computer; and an image forming apparatus that is connectable to said computer and that includes:

an image bearing body for bearing a latent image;

a developing device that is provided with:

a developer container for containing developer, said developer container not being provided with a stirring member for stirring said developer;

a developer bearing body for bearing the developer contained in said developer container; and a charging member for charging the developer borne by said developer bearing body by abutting against said developer bearing body, said charging member being electrically conductive, and said developer, which has been charged by said charging member, being used for developing the latent image borne by said image bearing body; and a turnable turning body to which said developing device is attached, wherein the charging member has a macromolecular elastic body and an electrical-conductive agent dispersed in the macromolecular elastic body.

* * * * *